United States Patent [19]

Berger et al.

[11] Patent Number: 4,967,490

[45] Date of Patent: Nov. 6, 1990

[54] DRYER EXHAUST VENT

[76] Inventors: Edwin Berger, 20 Reed Pl., Amityville, N.Y. 11701; Francis Sass, 3 Colonial St. East, Newport, N.Y. 11731

[21] Appl. No.: 476,034

[22] Filed: Feb. 6, 1990

[51] Int. Cl.[5] ..... F26B 19/00

[52] U.S. Cl. ..... 34/235; 34/243 R

[58] Field of Search ..... 34/235; 126/307 A, 307 R; 98/99.1, 110, 116, 119, 99 R, 99.8, DIG. 7

[56] References Cited

U.S. PATENT DOCUMENTS

| | | | |
|---|---|---|---|
| 2,963,956 | 12/1960 | Hill | 98/116 |
| 2,965,014 | 12/1960 | Lowery | 98/119 |
| 4,081,915 | 4/1978 | Materniak | 34/235 |
| 4,108,238 | 8/1978 | Vary et al. | 98/116 |
| 4,122,612 | 10/1978 | Mrofchak | 34/235 |
| 4,214,380 | 7/1980 | Meyer | 34/235 |
| 4,237,621 | 12/1980 | Boismenu | 34/235 |
| 4,334,461 | 6/1982 | Ferguson et al. | 34/235 |
| 4,449,549 | 5/1984 | Weck | 98/119 |

*Primary Examiner*—Henry A. Bennet
*Assistant Examiner*—Denise L. F. Gromada

[57] ABSTRACT

A dryer exhaust vent having a rectangular body bounding an air passage for the exiting moisture laden air from the dryer, in which multiple vanes for blocking reverse flow through the vent are pivotally mounted in the body opening which opens into the air passage so that the vanes pivotally traverse within the protective confines of the body and are not adversely effected by the weather, vandalism or the like.

1 Claim, 1 Drawing Sheet

DRYER EXHAUST VENT

The present invention relates to improvements for a venting attachment for a clothes dryer of the type which, when the dryer is in use, allows discharge to atmosphere of the moisture laden air from the dryer and, when not in use, blocks ambient air from reverse direction flow through the venting system back into the building through the dryer.

EXAMPLE OF THE PRIOR ART

The same type of dryer exhaust vent is illustrated and described in U.S. Pat. No. 4,214,380 issued to Meyer on July 29, 1980 with the important exception that the reverse flow blocking vanes 30 of this patent swing outwardly of frame 28 in which they are pivotally mounted, and consequently are not protected against the weather elements or against vandalism or other damage.

Broadly, it is an object of the present invention to embody improvements in a dryer exhaust vent overcoming the foregoing and other shortcomings of the prior art. More specifically, it is an object to locate the reverse flow blocking vanes internally of the vent, and thus within the protective confines of the vent housing, as well as to simplify the assembly of the vent, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
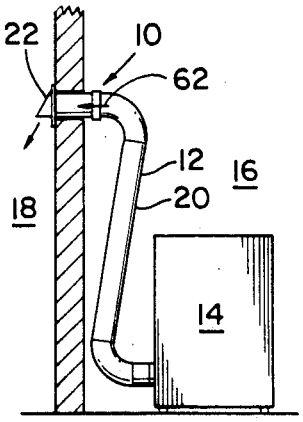
FIG. 1 is a side elevation showing a typical horizontal installation of the improved dryer exhaust vent of the present invention.

In FIG. 1 a so-called draft blocker assembly 10 is shown as part of the exhaust system 12 for clothes dryer 14. System 12 is needed to remove warm moist air from dryer 14 as it dries laundry during use. Air is drawn from within building 16, heated in dryer 14 and used to carry moisture from dryer 14 to atmospheric air 18 outside the building. When dryer 14 is not in use, vent 12 would allow ambient air 18 free access to the interior space 16, if it were not for draft blocker 10. The function of assembly 10 is to let air out vent system 12, but prevent outside air 18 from entering space 16, much in the manner of a check valve. The present invention is an improved draft blocker 10 or, as denominated in the description which follows and in the claims, a dryer exhaust vent.

Vent system 12 consists of a rigid or flexible duct 20, dryer exhaust assembly or vent 10 and an air exit device

22. Device 22 may be any one of several available hooded, screened, louvered weather shields that allow free exit of dryer air and that are appropriate from appearance and safety criteria for the particular building conditions.

Figure 4:
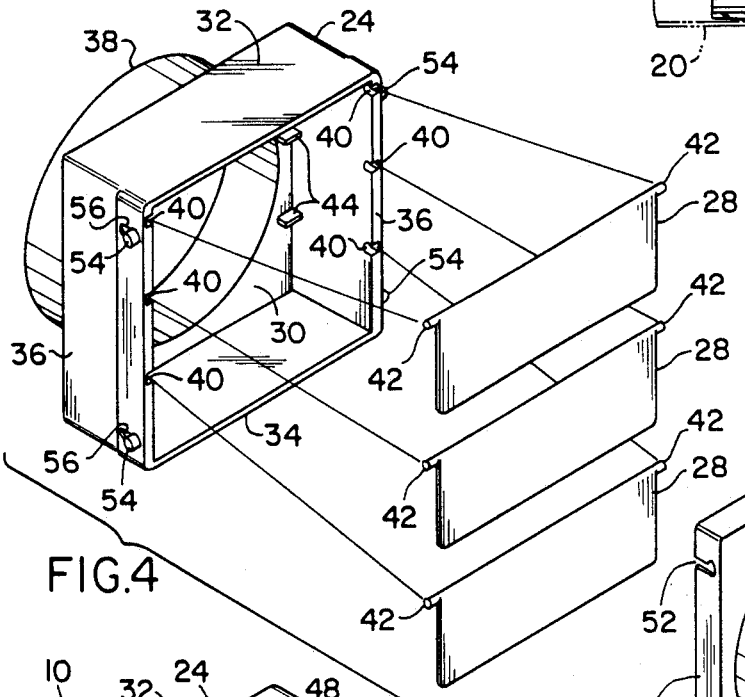
FIG. 4 is a view similar to FIG. 3, but showing the vent in disassembled relation to better illustrate details of the component parts thereof.
Figure 3:
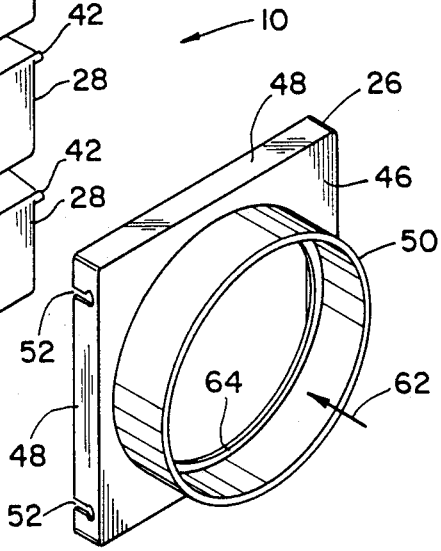
FIG. 3 is a perspective isolated view, on an enlarged scale, of the within inventive dryer exhaust in its assembled condition.
Figure 3:
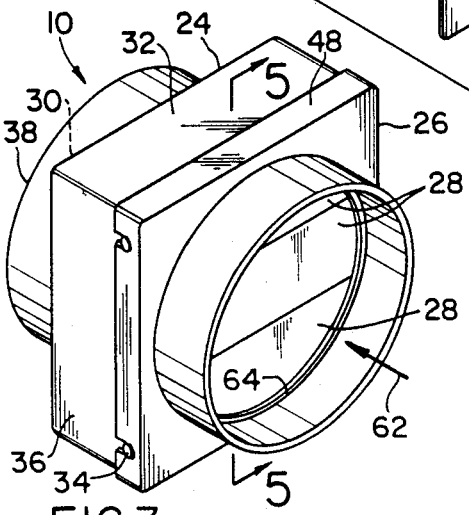

Vent 10 (FIGS. 3, 4 and 5) consisting of molded plastic parts, has a boxlike open rectangular body or housing 24, a housing cap 26 and a set of three vanes 28. Housing or body 24 has an outlet wall 30, a top wall 32, bottom wall 34 and a pair of side walls 36 which cooperate to bound an air passage between opposite inlet and outlet openings. More particularly, centrally located on the outside of wall 30 is an outlet collar 38 which bounds outlet opening from the housing air passage. Collar 38 is sized to fit within the inside diameter of associated downstream tubing or fittings. Housing 24 at its opposite side bounds an inlet opening into the air passage and has a set of six appropriately located recesses 40 (FIG. 4) along the edges of its side walls 36 which form the inlet opening. These recesses or notches are provided to receive the pivot stems 42 of vanes 28. Vanes 28 are each flat and of a rectangular size, slightly larger than one third the interior cross section of housing 24 and, thus, of the rectangular opening bounded by the housing walls 30, 32, 34 and 36. When stems 42 are seated in recesses 40, vanes 28 are free to rotate or pivot approximately 85 degrees counterclockwise (FIG. 5) until they contact stop members 44. Six of members 44 are strategically located within housing 24 to prevent vane "flutter" and undesirable noise of vane contact while dryer 14 is in operation.

Housing cover or cap 26 consists of an inlet wall 46 and a peripheral lip 48 sized and shaped to fit about the inlet opening of housing 24. On the upstream face of wall 46 an inlet collar 50 is located centrally and is sized to receive upstream ducting against a stop shoulder 64. Both collars 38 and 50 are adapted in practice to be connected to conventional rigid or flexible ducting and the usual customary vent fittings, by interference fit, banding, sealing cement, anchor screws, duct tape or the like.

Figure 6:
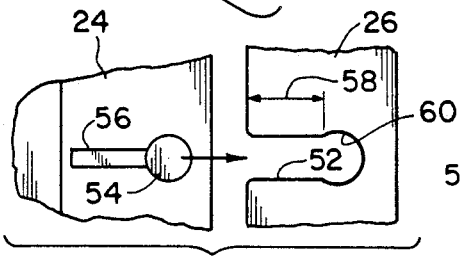
FIGS. 6 and 7 are detailed side elevational views of the attachment means for the cover component of the vent.
Figure 7:
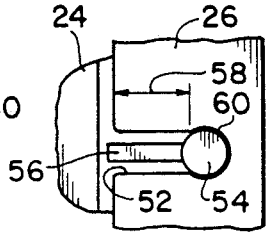

Lip 48, on housing cap 26, is made to have four interruptions 52, to match with corresponding studs 54 on housing 24. Each stud 54 is reinforced by a web 56. As best seen in FIGS. 6 and 7, each interruption 52 has an interference section 58 which opens to a receiving seat 60. At assembly, slight pressure is required to force studs 54 past interference sections 58 and into seats 60 which results in a snap fit. It is to be noted that cap 26 retains vanes 28 in their respective pivot seats 40.

Figure 2:
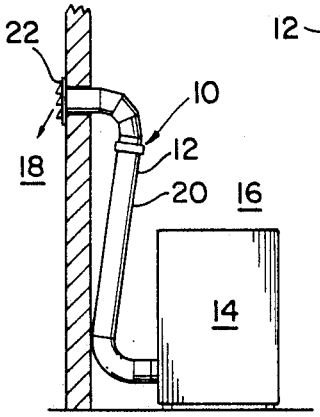
FIG. 2 is a view similar to FIG. 1 showing an alternate vertical installation.

When ready for use, draft blocker 10 can be readily installed in an already installed exhaust system 12. It is preferred that device 10 be located near exit device 22 with the flow axis 62 in a horizontal plane. Assembly 10 will function equally as well, however, when mounted in a "vertical" orientation as shown in FIG. 2.

Figure 5:
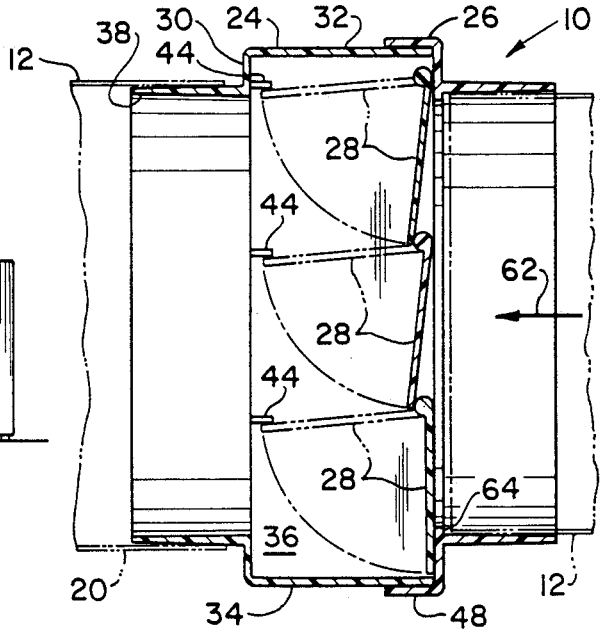
FIG. 5 is a cross sectional view as taken along line 5—5 of FIG. 3.

When in use, warm moist air from dryer 14 is forced through duct 20 and into unit 10 where vanes 28 lift and stop against members 44. Vanes 28 remain "open" while dryer 14 discharges air. At the end of the dryer cycle, vanes 28 revert to a vertical slightly overlapped position (FIG. 5). Under back draft conditions, vanes 28 remain vertical in said overlap relation and, thus, effectively block air movement from the building exterior 18 to the building interior 16.

From the foregoing description it should be readily appreciated that among other noteworthy features, the within inventive dryer exhaust vent 10 provides the necessary one-direction flow control through its housing 24 using the plural vanes 28, and that said vanes are protected against deterioration by weather elements and other damage by their containment within the housing.

While the particular dryer exhaust vent and assembly method herein shown and disclosed in detail is fully capable of attaining the obJects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved dryer exhaust vent comprising an open rectangular body forming an air passage between opposite ends, a pair of cooperating housing caps having an inlet opening into said air passage and an exit openings therefrom, said housing caps defining entrance and exit duct connection means, three pair of spaced notch means having entranceways located along opposite sides of the body edge bounding said inlet opening, and three vanes each having end pivots laterally extending from an upper edge and collectively sized to serve as a closure for said inlet opening, said vanes being mounted by their end pivots in said pairs of notch means and being mounted therein such that said top and middle vanes have their lower edges in slightly overlapped relation, said vanes being movable from said overlapped relation through a pivotal traverse into said air passage towards said exit opening, said inlet opening housing caps being removable and being mounted against said body edge bounding said inlet opening whereby said entranceways of said notch means are closed to retain said vanes within said notches, whereby discharging air is exhausted between the vanes while said vanes remain protected against weather elements within the confines of said air passage.

* * * * *